US008215999B2

(12) United States Patent
Lau et al.

(10) Patent No.: US 8,215,999 B2
(45) Date of Patent: Jul. 10, 2012

(54) AUXILIARY ELECTRIC SOCKET FOR AUTOMOBILE

(75) Inventors: Francis Lau, Labruguière (FR); Jean-Louis Bonnet, Saint Amans Valtoret (FR); Jean-Michel Can, Revel (FR); Michel Garric, Escoussens (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 12/529,059

(22) PCT Filed: Feb. 27, 2008

(86) PCT No.: PCT/EP2008/052390

§ 371 (c)(1),
(2), (4) Date: Jun. 20, 2011

(87) PCT Pub. No.: WO2008/107354

PCT Pub. Date: Sep. 12, 2008

(65) Prior Publication Data

US 2012/0094543 A1 Apr. 19, 2012

(30) Foreign Application Priority Data

Mar. 6, 2007 (FR) ..... 07 01633

(51) Int. Cl.
*H01R 24/04* (2006.01)

(52) U.S. Cl. ..... 439/668

(58) Field of Classification Search ..... 439/660, 439/668, 700, 722, 736, 824, 558, 521; 219/267
See application file for complete search history.

(56) References Cited

U.S. PATENT DOCUMENTS

| | | | | |
|---|---|---|---|---|
| 4,650,270 | A | 3/1987 | Tajima et al. | |
| 4,713,017 | A | 12/1987 | Pesapane | |
| 5,044,993 | A | 9/1991 | El-Haj et al. | |
| 5,230,641 | A | 7/1993 | Wharton | |
| 6,619,983 | B2 | 9/2003 | Ota et al. | |
| 7,063,447 | B2 * | 6/2006 | Andrieu et al. | 362/488 |
| 7,193,182 | B2 * | 3/2007 | Can et al. | 219/267 |
| 2001/0051460 | A1 | 12/2001 | Ota et al. | |
| 2005/0082270 | A1 * | 4/2005 | Can et al. | 219/267 |
| 2011/0132889 | A1 * | 6/2011 | Bae | 219/265 |

FOREIGN PATENT DOCUMENTS

| | | | |
|---|---|---|---|
| DE | 4436794 | A1 | 4/1996 |
| EP | 1164666 | A2 | 12/2001 |
| WO | 8101631 | A1 | 6/1981 |

* cited by examiner

*Primary Examiner* — Tulsidas C Patel
*Assistant Examiner* — Phuongchi Nguyen
(74) *Attorney, Agent, or Firm* — Jacox, Meckstroth & Jenkins

(57) ABSTRACT

An auxiliary electrical socket for automobile vehicles that includes a unitary body having a connecting tongue and a barrel adapted to receive a plug. This socket also includes a one-piece assembly that has a connecting member and a ring. The ring receives the barrel and constitutes a member for joining the socket and a structural element of the vehicle. The unitary body and the one-piece assembly include integral nesting-type assembly and positioning means.

22 Claims, 3 Drawing Sheets

AUXILIARY ELECTRIC SOCKET FOR AUTOMOBILE

CROSS-REFERENCE TO RELATED APPLICATIONS

This application claims priority to PCT Application PCT/EP2008/052390 filed Feb. 27, 2008 and also to French Application No. 0701633 filed Mar. 6, 2007, which applications are incorporated herein by reference and made a part hereof.

BACKGROUND OF THE INVENTION

1. Field of the Invention

The field of the present invention is that of automobile equipment relating to conductive electrical connections produced by structural combination of a number of mutually-insulated electrical connection members. Its subject matter is an auxiliary electrical socket intended to be fitted to an automobile vehicle for the occasional supply of power to an accessory provided with a complementary plug.

2. Description of the Related Art

In the automobile field, a vehicle is frequently equipped with an auxiliary electrical socket which is available to a passenger for the occasional supply of electrical power to an accessory device, such as a mobile telephone, for example. Such accessory devices are generally provided with a plug including a body of globally cylindrical shape that carries a first connecting terminal at its periphery and a second connecting terminal at its distal end.

To connect the contacts of the plug with the terminals of the electrical circuit of the vehicle that are assigned to them, the socket includes a cylindrical first conductive element for connecting it to the body of the plug, extended by a first pin. A second conductive element takes the form of a plate against which the second contact of the plug bears, extended by a second pin. The respective pins are intended to be connected to a voltage terminal and a ground terminal of the electrical circuit of the vehicle to deliver to the accessory device a low direct-current voltage, for example of the order 12 V, 24 V, even 42 V. An electrically-insulative connecting member at the distal end of the socket electrically insulates the conductive elements from each other, and can even provide a mechanical connection between the socket and the terminals. Moreover, the socket is equipped with a member for joining it to a structural element of the vehicle, such as a dashboard, console or similar structural element. This joining member is conformed as a ring, for example, intended to be introduced into a housing that the structural element comprises for this purpose. See for example the documents U.S. Pat. No. 5,044,993 (EI-HAJ et al.) and U.S. Pat. No. 4,713,017 (PESAPANE), which describe auxiliary electrical sockets of the kind referred to above.

SUMMARY OF THE INVENTION

One aim is to obtain the socket at lower cost, in particular by simplifying its structure and its production. It is desirable for the structure of the socket to simplify assembling its components and mounting it on the structural element of the vehicle. This structural simplification must not be achieved to the detriment of the reliability of the electrical connection obtained between the plug and the terminals and must not affect how strongly the socket is retained on the structural element of the vehicle. Given these requirements, there must in particular be taken into account the frequent and repetitive operations of introducing and withdrawing the plug, and the structure of the socket must be intrinsically robust, reliable and durable in such use.

The object of the present invention is to propose an electrical socket intended to be fitted to an automobile vehicle for the occasional supply of power to an accessory equipped with a complementary plug. The present invention more particularly aims to propose a socket of this kind that can be produced at lower cost and can easily be installed on a structural element, whilst being robust, reliable and durable.

The device of the present invention is an auxiliary electrical socket adapted to be fitted to an automobile vehicle for the occasional supply of electrical power to an accessory device equipped with a complementary plug. This socket includes:

a ring joining the socket to the interior of a housing of a structure element of the vehicle, a connecting member at the bottom of the socket for nesting the latter over the terminals of an electrical circuit of the vehicle, and a pair of conductive elements for making an electrical connection between contacts of the plug and the terminals that are assigned to them, including a cylindrical first conductive element extended by a first pin and a second conductive element conformed as a plate extended by a second pin.

The cylinder of the first conductive element is more particularly intended to cooperate with a body of the plug carrying a first contact and the first pin is intended to cooperate with the corresponding terminal of the electrical circuit of the vehicle. The plate of the second conductive element is intended to come into axial contact with a second contact carried by the body of the plug and the second pin is intended to cooperate with the terminal of the electrical circuit of the vehicle that is assigned to it. The connecting member is adapted to electrically insulate the conductive elements from each other and preferably to produce a mechanical connection between the socket and the terminals.

According to the present invention, such a socket is distinctive mainly in that it has the following features, separately or in combination:

The first conductive element consists of a unitary body consisting of a barrel nested inside the ring and adapted to receive the plug and a first connecting tongue of the first pin. The barrel is advantageously disposed radially between the ring and the plug and joins the unitary body to the ring as well as providing a cylindrical first conductive element adapted to cooperate with the plug.

The ring and the connecting member are integrated into a one-piece assembly. For a strong connection of the socket to the vehicle, the one-piece assembly is advantageously a rigid member disposed between the structural element and the terminals of the electrical circuit. This also facilitates positioning it and making the mechanical connection with the structural element and the electrical connections to the terminals of the circuit of the vehicle when mounting the socket on the vehicle.

The socket comprises means for assembling together the unitary body and the one-piece assembly. These assembly means can advantageously be of the nesting type relying on respective and cooperating integral assembly members of the unitary body and the one-piece assembly. More particularly, placing the members constituting the socket between two joined members respectively consisting of the unitary body and the one-piece assembly facilitates their assembly by nesting by means of respective and cooperating integral assembly members. As a result, the assembly means are obtained at lower cost and speed up and facilitate assembly of the components of the socket.

The socket proposed by the invention advantageously consists of a small number of components adapted to be assembled together, and in particular the unitary body, the one-piece assembly and the second conductive element. By virtue of their inherent structure, these components can be assembled and the socket mounted on the structural element of the vehicle by nesting processes without requiring attached assembly members.

These features simplify assembling the socket and mounting it on the structural element, the socket consisting essentially of the unitary body and the one-piece assembly, which have integral nesting members for assembling them to each other and for mounting the socket on the structural element of the vehicle. The second conductive element can be structurally reduced to the plate and the second pin conjointly formed from the same metal sheet, attached by nesting it over the connecting member, which includes a raised pattern provided for this purpose. These features are also such that accurate relative positioning of the terminals of the electrical circuit of the vehicle and the contacts of the plug is easily achieved by virtue of the means for assembling the unitary body and the one-piece assembly to each other. These assembly means preferably include integral radial positioning means and means for axial abutment of the unitary body against the one-piece assembly during their mutual nesting, in order to position the pins in corresponding relationship to the terminals. The connection between the plug and the terminals is obtained simply, easily and at lower cost, is robust because of the rigid nature of the one-piece assembly disposed between the structural element and the terminals, and by virtue of the assembly means achieves reliable relative positioning of the plug and the terminals.

The one-piece assembly is advantageously adapted to be produced by molding an electrically insulative plastic material. The proposed division of the structure of the socket into a unitary body and a one-piece assembly means that the ring and the connecting member can be produced in a single molding operation at lower cost and, because of the integral members for assembling them to each other, eliminates assembly operations. Eliminating all risk of inadequate electrical connection means that the connection between the plug and the terminals is not only mechanically strong but also electrically reliable.

The assembly means are advantageously of the type entailing axial nesting of the unitary body inside the one-piece assembly and advantageously combine means for radial positioning and means for axial positioning of the unitary body relative to the one-piece assembly.

The radial positioning means advantageously consist of a first window formed in the connecting member for the first tongue to nest in. This first window is in particular radially offset relative to the axis along which the unitary body is nested inside the one-piece assembly.

The means for axially positioning the unitary body inside the one-piece assembly are more particularly adapted to limit the axial travel of the unitary body toward the interior of the one-piece assembly on its introduction therein, complemented in an accessory manner by opposed axial bearing points of the unitary body on the one-piece assembly.

A first embodiment of the axial positioning means entails clipping the unitary body onto the one-piece assembly with two opposed axial bearing points. These opposed axial bearing points consist of respective and cooperating joining members integral with the unitary body and with the one-piece assembly. For example, the bottom of the unitary body bears axially against the connecting member and integrates a clip or similar member for opposed bearing against the one-piece assembly, for example against the edge of a window in the latter.

A second embodiment of the axial positioning means consists of a bent portion that includes the first tongue adapted to bear axially against the connecting member. In an accessory manner, the connecting member integrates a raised pattern to receive this bent portion so that it bears more firmly on the bottom of the connecting member.

A preferred embodiment of the one-piece assembly includes a cage formed by extending the ring as far as the connecting member. In particular this cage produces a space for the plug to pass through toward the connecting member and can even also envelope the unitary body to protect it and prevent accidental electrical contact with elements around the socket installed on the structural element. Such a cage can also and advantageously be used for assembling the unitary body and the one-piece assembly by elastic nesting (clipping) and even for clipping the one-piece assembly to the structural element of the vehicle.

To achieve tight elastic nesting of the unitary body inside the one-piece assembly, the cage and/or the unitary body are preferably elastically deformable on introduction of the unitary body into the one-piece assembly. The one-piece assembly advantageously being obtained by molding a plastic material, it can easily integrate various auxiliary members, in particular for strengthening it and improved guidance inside the housing of the structural element.

For example, the cage is advantageously provided with axial stiffeners further forming ramps for guiding introduction of the one-piece assembly into the housing of the structural element.

The second conductive element is attached by nesting it over the connecting member. For example, a second tongue of the second pin is introduced through a second window in the connecting member and the plate is placed inside the one-piece assembly, at the bottom. This window can be either coaxially oriented or radially offset relative to the axis along which the unitary body is nested inside the one-piece assembly.

The one-piece assembly is preferably provided with a polarizer for radially positioning the socket on the structural element and accurately lining up the tongues and the terminals.

The one-piece assembly is preferably clipped onto the structural element between two opposed axial bearing points provided in particular by axial bearing engagement of the one-piece assembly on respective opposite sides of a wall of the structural element including the housing to receive the socket.

For example, the ring has a shoulder for introducing it and for its bearing engagement with the front face of the wall and the cage preferably includes, in the vicinity of the area in which it is joined to the ring, opposed raised patterns bearing axially against the rear face of the wall. This leads to fast, easy, reliable and durable installation of the socket on the structural element of the vehicle from the front face thereof.

The present invention also proposes methods for producing a first conductive element of such a socket.

In a first embodiment, the first conductive element is produced by a single operation of stamping a metal blank to form simultaneously the barrel, the first tongue and the ring through which the unitary body bears axially against the connecting member.

In a second embodiment, the first conductive element is produced by cutting a metal sheet to produce a mutually orthogonal strip and blade, this cutting operation being followed by shaping the flat cut metal sheet to roll it to form the barrel and to bend it back on itself to form the first tongue and its bent portion.

BRIEF DESCRIPTION OF THE ACCOMPANYING DRAWINGS

The present invention will be better understood and details thereof will become apparent on reading the following description of embodiments given with reference to the figures of the appended drawings, in which.

DETAILED DESCRIPTION OF THE PREFERRED EMBODIMENTS

Figures 1, 2:
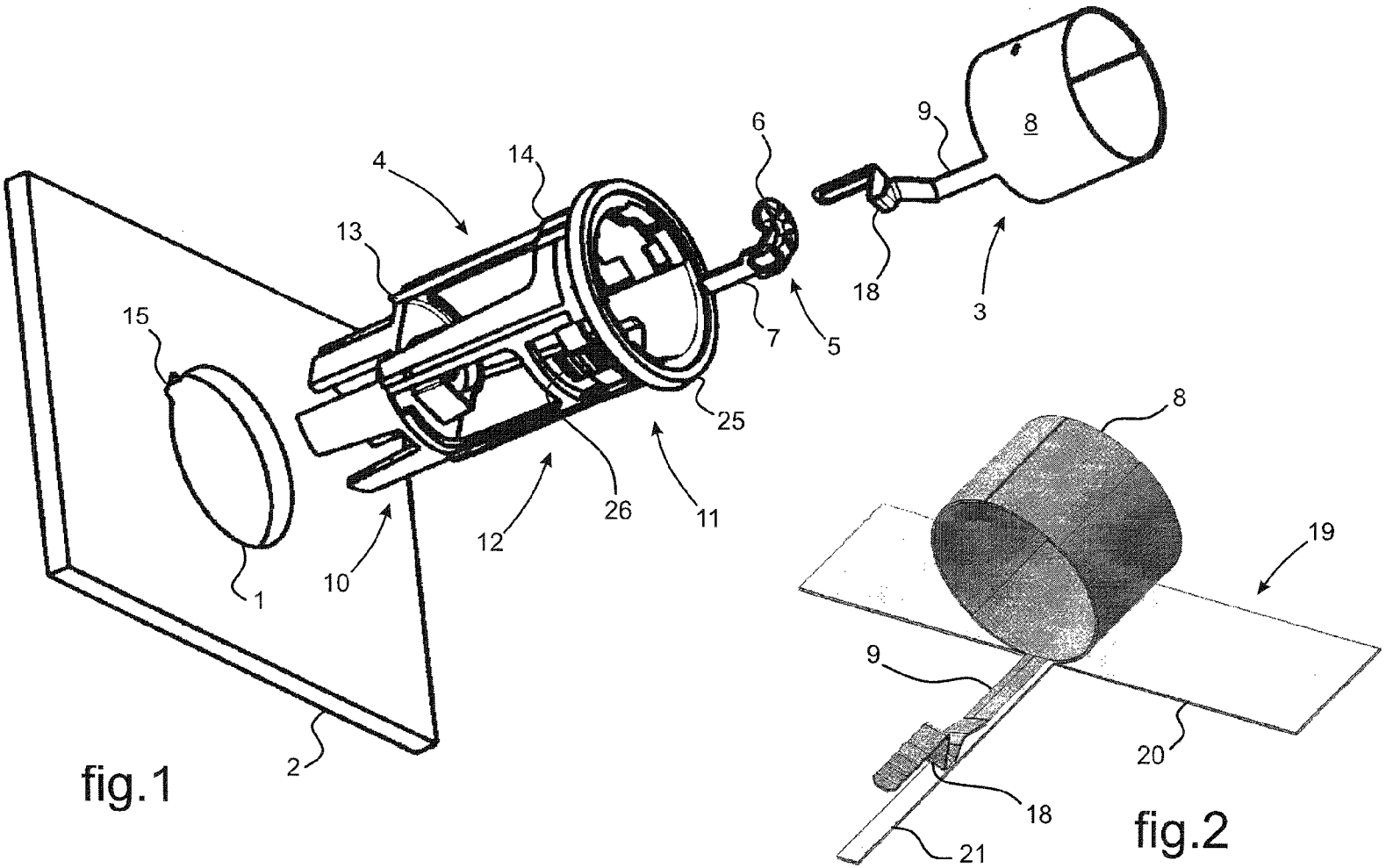
FIG. 1 is an exploded perspective view of a socket of a first embodiment of the present invention.
FIG. 2 is a perspective view of a method of producing a conductive element of the socket represented in FIG. 1.

FIG. 1 and FIGS. 3 to 5 show a socket adapted to be fitted to a vehicle for the occasional supply of electrical power to an accessory. Such an accessory is commonly equipped with a plug comprising a cylindrical body provided with a peripheral first contact and an axial second contact. The socket is intended to be received inside a housing 1 in a structural element 2 of the vehicle, in particular a dashboard or the like, as shown diagrammatically in FIG. 1. The socket is in particular adapted to make a reliable electrical connection between the plug that it occasionally receives and terminals of an electrical circuit of the vehicle.

The socket consists mainly of a unitary body 3 that is part of a first conductive element and a one-piece assembly 4 that carries the unitary body 3 and a second conductive element 5. The unitary body 3 and the one-piece assembly 4 are assembled together by nesting of respective and cooperating integral members. The second conductive element 5 consists of a plate 6, for example, placed at the bottom of the one-piece assembly 4 to cooperate with the axial second contact of the plug and provided with a tongue 7 that extends toward a corresponding terminal of the circuit. The second conductive element 5 is advantageously attached by nesting it over the one-piece assembly 4.

The unitary body 3 consists of a barrel 8 that is extended by a first pin in the form of a first tongue 9. The barrel 8 is adapted to be disposed between the plug and the one-piece assembly 4 on axially receiving the body of the plug and the unitary body 3 therefore constitutes both an electrical connecting member and a mechanical connecting member between the plug and the socket.

The one-piece assembly 4 is produced by molding an electrically insulative plastic material and integrates a connecting member 10 and a ring 11 for fastening the socket to the interior of the housing 1 of the structural element 2. The connecting member 10 and the ring 11 are connected to each other by a cage 12 forming a spacer to define a space for the axial passage of the body of the plug toward the connecting member 10. This cage 12 is stiffened by peripheral stiffeners 13, which further constitute guides to facilitate introduction of the socket into the interior of the housing 1. As can be seen in FIG. 1, the ring 11 is preferably provided with a polarizer 14 adapted to cooperate with a corresponding relief 15 in the structural element 2. These features facilitate radial positioning of the socket on the structural element 2.

The nested assembly of the unitary body 3 and the one-piece assembly 4 positions them relative to each other both axially and radially, to line up the tongues 7, 9 with the terminals of the electrical circuit. The one-piece assembly 4 can be disposed between the unitary body 3 and the housing 1 on axial reception of the barrel 8 inside the ring 11 and reception of the first tongue 9 in a first window 16 in the connecting member 10, visible in FIG. 5. The connecting member 10 also includes a second window 17 through which the second tongue 7 of the second conductive element 5 passes. It follows from this that the unitary body 3 is axially introduced into and radially positioned in the one-piece assembly. The travel on introduction of the unitary body 3 into the one-piece assembly is limited by axial positioning means.

In the alternative embodiment shown in FIG. 1, the axial positioning means consist of a bent portion 18 of the first tongue 9 adapted to abut against the connecting member 10. Referring to FIG. 2, the first conductive element consisting of the unitary body 3 is formed by cutting a metal sheet 19 into a strip 20 and a tongue 21 that are mutually orthogonal. The strip 20 is rolled to form the barrel 8 and the tongue 21 is bent to form the first tongue 9 and its bent portion 18.

Figure 3:
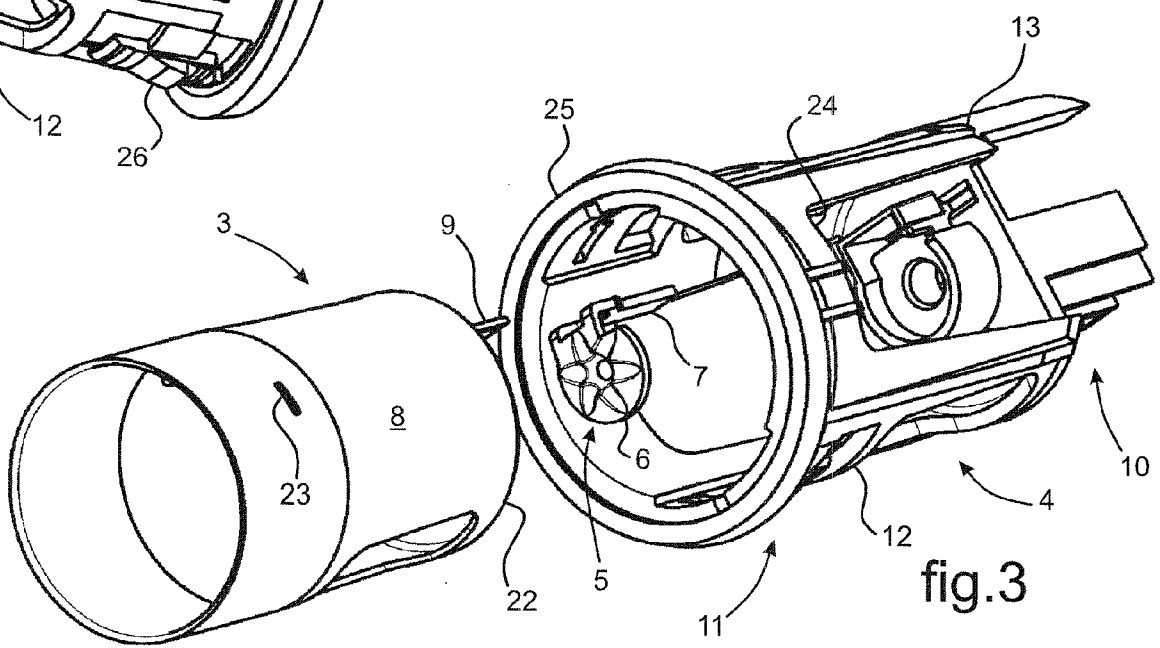
FIGS. 3 to 5 are views of a socket of a second embodiment of the present invention, respectively an exploded perspective view, an assembled perspective view and a perspective view from one end.
Figure 4:
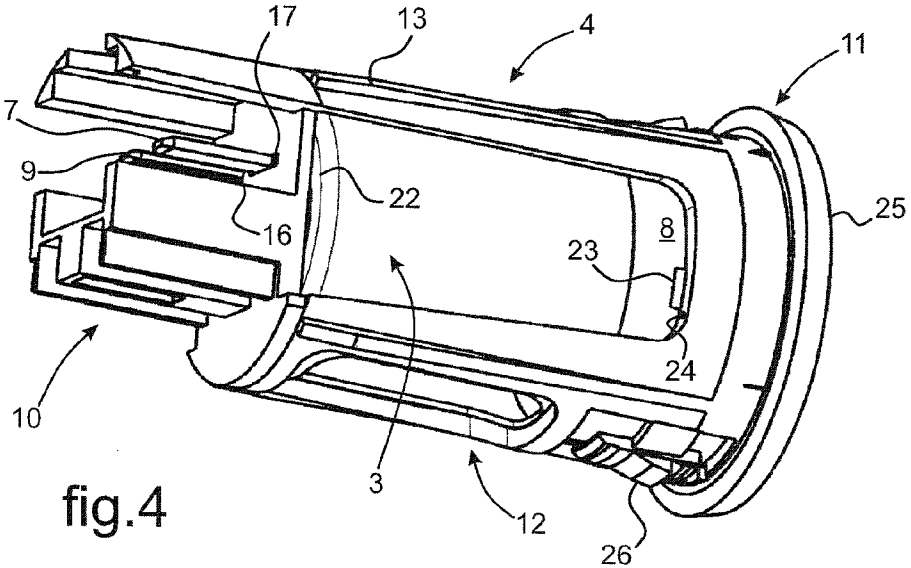
Figure 5:
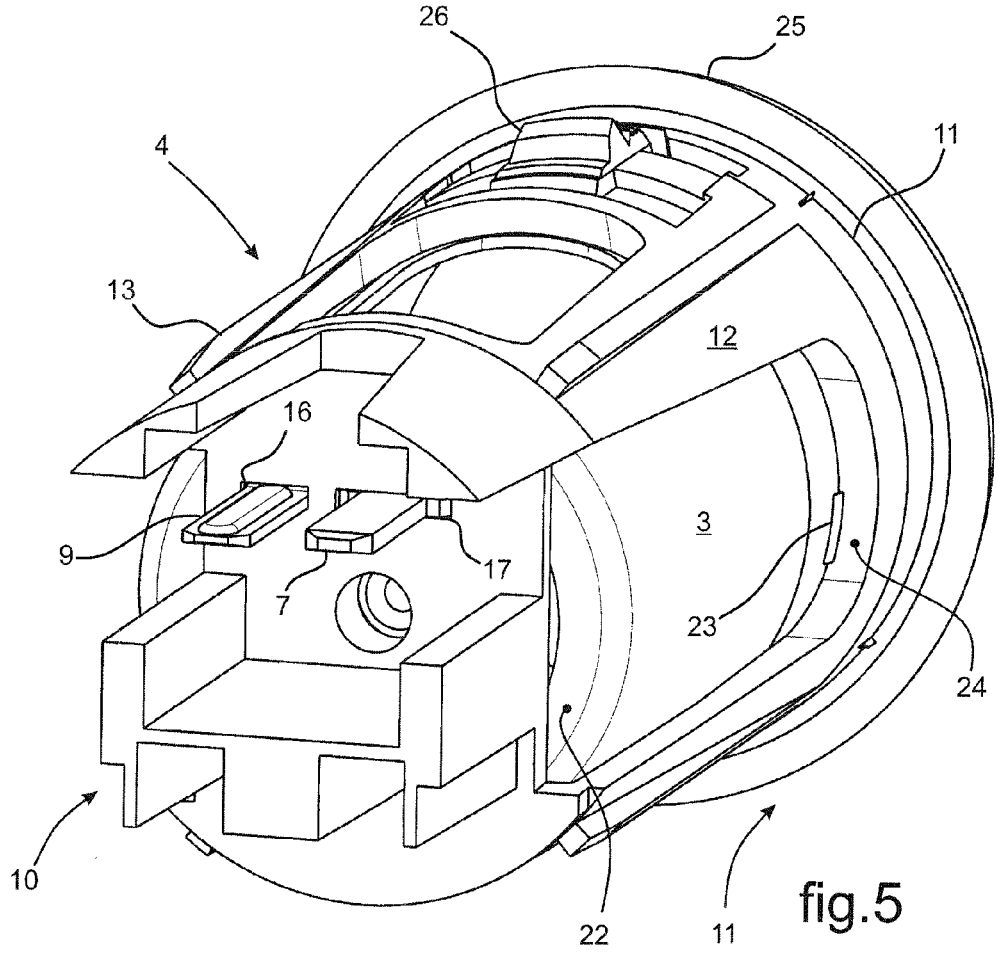
Figure 6:
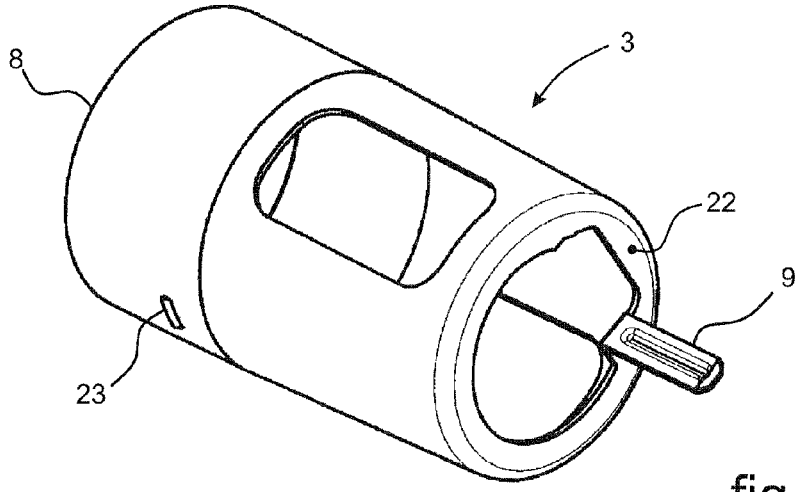
FIG. 6 is a perspective view of a conductive element of the socket represented in FIGS. 3 to 5.

In the embodiment shown in FIGS. 3 to 5, axial positioning is achieved by clipping the unitary body 3 onto the one-piece assembly 4 between opposed axial bearing points. One of these axial bearing points 22 is formed by a ring at the distal end of the unitary body 3 and is adapted to bear against the connecting member 10. The other axial bearing point 23 is formed by a projection on the barrel 8 that bears against the edge of a window 24 in the cage 12 in the vicinity of its area joined to the ring 11. The unitary body 3 shown in FIG. 6 is advantageously formed by stamping a metal blank to form in a single operation the barrel 8, the axial bearing point 22 and the first tongue 9, and even the axial bearing point 23.

In an embodiment that is not shown, the socket of the present invention is produced by molding the one-piece assembly 4 onto the unitary body 3.

The one-piece assembly 4 is clipped to the structural element 2 after receiving the unitary body 3 and is immobilized axially between two opposed axial bearing points. One bearing point 25 is formed by a flange of the ring 11 and the other bearing point 26 is formed by raised patterns at the periphery of the cage 12 in the vicinity of the bearing point 25. It follows that when the socket is mounted on the structural element 2 it is positioned radially by the polarizer 14 and axially by virtue of being engaged with respective opposite sides of the wall of the structural element 2 in which the housing 1 is formed.

While the forms of apparatus herein described constitutes preferred embodiments of this invention, it is to be understood that the invention is not limited to these precise forms of apparatus, and that changes may be made therein without departing from the scope of the invention which is defined in the appended claims.

What is claimed is:

1. An auxiliary electrical socket adapted to be fitted to an automobile vehicle for the occasional supply of electrical power to an accessory device equipped with a complementary plug, this socket comprising:

a ring joining the socket to the interior of a housing of a structural element of the vehicle, a connecting member at the bottom of the socket for nesting the latter over terminals of an electrical circuit of the vehicle, and a pair of conductive elements for making an electrical connection between contacts of the plug and said terminals that are assigned to them, including a cylindrical first conductive element extended by a first pin and a second conductive element conformed as a plate extended by a second pin, wherein said auxiliary electrical socket comprises:

the cylindrical first conductive element consists of a unitary body consisting of a barrel nested inside the ring and adapted to receive the complementary plug and a first connecting tongue of the first pin, the ring and the connecting member are integrated into a one-piece assembly, and means for assembling together the unitary body and the one-piece assembly.

2. The auxiliary electrical socket according to claim 1, wherein axial positioning means are adapted to limit the travel of the unitary body toward the interior of the one-piece assembly upon its axial introduction therein and are complemented by opposed axial bearing points of the unitary body on the one-piece assembly.

3. The auxiliary electrical socket according to claim 1, wherein the second conductive element is attached by nesting it over the connecting member, the second pin is introduced through a second window in the connecting member and the plate is inside the one-piece assembly, at the bottom.

4. The auxiliary electrical socket according to claim 1, wherein the one-piece assembly has a polarizer for radially positioning a female socket on the structural element and lining up tongues with the terminals.

5. The auxiliary electrical socket according to claim 1, wherein said one-piece assembly is mounted by clipping it onto the structural element between two opposed axial bearing points.

6. The auxiliary electrical socket according to claim 1 wherein the one-piece assembly includes a cage formed by extending the ring as far as the connecting member.

7. The auxiliary electrical socket according to claim 6, wherein the cage is provided with axial stiffeners forming guide ramps for introducing the one-piece assembly into the housing of the structural element.

8. The auxiliary electrical socket according to claim 1, wherein said auxiliary electrical socket is advantageously produced by molding the one-piece assembly onto the unitary body.

9. The auxiliary electrical socket according to claim 8, wherein radial positioning means consist of a first window in the connecting member in which a first tongue is adapted to nest.

10. The auxiliary electrical socket according to claim 8, wherein axial positioning means are adapted to limit the travel of the unitary body toward the interior of the one-piece assembly upon its axial introduction therein and are complemented by opposed axial bearing points of the unitary body on the one-piece assembly.

11. The auxiliary electrical socket according to claim 1, wherein assembly means are advantageously of the type relying on axial nesting of the unitary body inside the one-piece assembly and combine means for radially positioning and means for axially positioning the unitary body relative to the one-piece assembly.

12. The auxiliary electrical socket according to claim 11, wherein radial positioning means consist of a first window in the connecting member in which a first tongue is adapted to nest.

13. The auxiliary electrical socket according to claim 12, wherein axial positioning means are adapted to limit the travel of the unitary body toward the interior of the one-piece assembly upon its axial introduction therein and are complemented by opposed axial bearing points of the unitary body on the one-piece assembly.

14. The auxiliary electrical socket according to claim 1, wherein the one-piece assembly is formed by molding an electrically insulative material.

15. The auxiliary electrical socket according to claim 14, wherein assembly means are advantageously of the type relying on axial nesting of the unitary body inside the one-piece assembly and combine means for radially positioning and means for axially positioning the unitary body relative to the one-piece assembly.

16. The auxiliary electrical socket according to claim 14, wherein the one-piece assembly includes a cage formed by extending the ring as far as the connecting member.

17. The auxiliary electrical socket according to claim 14, wherein the electrically insulative material is a plastic material.

18. The auxiliary electrical socket according to claim 17, wherein assembly means are advantageously of the type relying on axial nesting of the unitary body inside the one-piece assembly and combine means for radially positioning and means for axially positioning the unitary body relative to the one-piece assembly.

19. The auxiliary electrical socket according to claim 17, wherein the one-piece assembly includes a cage formed by extending the ring as far as the connecting member.

20. An auxiliary electrical socket adapted to be fitted to an automobile vehicle for the occasional supply of electrical power to an accessory device equipped with a complementary plug, this socket comprising:

a ring joining the socket to the interior of a housing of a structural element of the vehicle, a connecting member at the bottom of the socket for nesting the latter over terminals of an electrical circuit of the vehicle, and a pair of conductive elements for making an electrical connection between contacts of the plug and said terminals that are assigned to them, including a cylindrical first conductive element extended by a first pin and a second conductive element conformed as a plate extended by a second pin, wherein said auxiliary electrical socket comprises:

the cylindrical first conductive element consists of a unitary body consisting of a barrel nested inside the ring and adapted to receive the complementary plug and a first connecting tongue of the first pin, the ring and the connecting member are integrated into a one-piece assembly.

21. The auxiliary electrical socket according to claim 20, wherein the one-piece assembly is formed by molding an electrically insulative material.

22. The auxiliary electrical socket according to claim 21, wherein the electrically insulative material is a plastic material.

* * * * *

UNITED STATES PATENT AND TRADEMARK OFFICE

CERTIFICATE OF CORRECTION

PATENT NO. : 8,215,999 B2
APPLICATION NO. : 12/529059
DATED : July 10, 2012
INVENTOR(S) : Francis Lau et al.

It is certified that error appears in the above-identified patent and that said Letters Patent is hereby corrected as shown below:

In the Specification

In Column 1, Line 52, please delete "(EI-HAJ et al.)" and insert -- (EL-HAJ et al.) -- therefor.

Signed and Sealed this
Fourth Day of February, 2014

Michelle K. Lee

Michelle K. Lee
*Deputy Director of the United States Patent and Trademark Office*